US007134664B2

(12) United States Patent
Tom et al.

(10) Patent No.: US 7,134,664 B2
(45) Date of Patent: Nov. 14, 2006

(54) MODULAR BULLET TRAP COVER

(75) Inventors: Joe G. Tom, Vicksburg, MS (US); Charles A. Weiss, Jr., Clinton, MS (US); Steven L. Larson, Vicksburg, MS (US); Philip G. Malone, Vicksburg, MS (US); Edward J. Fransen, Irvine, CA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/890,846

(22) Filed: Jul. 9, 2004

(65) Prior Publication Data

US 2004/0239037 A1 Dec. 2, 2004

Related U.S. Application Data

(63) Continuation-in-part of application No. 10/307,427, filed on Dec. 2, 2002, now Pat. No. 6,837,496.

(51) Int. Cl.
*F41J 1/12* (2006.01)
*B65D 30/08* (2006.01)

(52) U.S. Cl. ..... 273/410; 383/111

(58) Field of Classification Search ..... 273/404–410; 383/109–116

See application file for complete search history.

(56) References Cited

U.S. PATENT DOCUMENTS 3,061,170 A * 10/1962 Baker ..... 383/109
4,951,666 A * 8/1990 Inman et al. ..... 607/114
4,953,674 A * 9/1990 Landes ..... 190/108
5,435,571 A 7/1995 Wojcinski et al.
5,553,943 A * 9/1996 Cook et al. ..... 383/113
5,607,163 A 3/1997 Nesler
5,799,948 A * 9/1998 Moberg ..... 273/410
5,848,794 A 12/1998 Wojcinski et al.
5,901,960 A 5/1999 Nesler et al.

(Continued)

FOREIGN PATENT DOCUMENTS

WO WO 91/17408 11/1991

*Primary Examiner*—Mark S. Graham
(74) *Attorney, Agent, or Firm*—Scott A. Felder; Nicholas J. Landau; Earl H. Baugher, Jr.

(57) ABSTRACT

A modular bullet trap cover element generally includes a shell filled with a projectile trapping medium, preferably a mixture of a resilient granular ballistic medium and a hydrated super absorbent polymer (SAP) gel. The shell may be made of any of a number of fabric or polymeric materials. In embodiments, the shell includes at least two bags, an inner bag and at least one outer bag, each of which has an open end and a sealed end, connected to one another such that the outer bags may be inverted over the inner bag to cover at least a portion thereof. The modular cover element is formed by filling the inner bag with the projectile trapping medium and then inverting the outer bags to produce a multi-layer shell. In embodiments, the outer bags and inner bag are rotatably connected, permitting the outer bags to be rotated with respect to the inner bag such that bullet holes in the inner and outer bags no longer line up with each other. Several modular cover elements may be fixedly or releasably interconnected, preferably in a mattress-like arrangement, to form a bullet trap cover.

30 Claims, 6 Drawing Sheets

U.S. PATENT DOCUMENTS 5,984,951 A * 11/1999 Weiss et al. ..... 607/109
6,000,700 A 12/1999 Nesler et al.
6,027,120 A 2/2000 Wojcinski et al.
6,173,956 B1 1/2001 O'Neal
6,264,735 B1 7/2001 Bean et al.
6,293,552 B1 9/2001 Wojcinski et al.
6,378,870 B1 4/2002 Sovine
6,446,974 B1 9/2002 Malone et al.
6,573,358 B1 6/2003 Michels et al.
2003/0186043 A1 * 10/2003 Koslow ..... 428/306.6

* cited by examiner

MODULAR BULLET TRAP COVER

RELATED APPLICATIONS

This Application is a continuation-in-part of application Ser. No. 10/307,427, filed Dec. 2, 2002, now U.S. Pat. No. 6,837,496 B2.

STATEMENT REGARDING FEDERALLY SPONSORED RESEARCH OR DEVELOPMENT

Under paragraph 1(a) of Executive Order 10096, the conditions under which this invention was made entitle the Government of the United States, as represented by the Secretary of the Army, to the entire right, title and interest therein of any patent granted thereon by the United States. This patent and related ones are available for licensing. Contact Phillip Stewart at 601 634-4113.

BACKGROUND OF THE INVENTION

1. Field of the Invention

The present invention relates generally to the construction of bullet trapping backstops, and, more particularly, to covering loose-particulate projectile backstops.

2. Background Description

In order to maintain proficiency in the use of firearms, it is common to engage in target practice on a training range. Of great concern on a training range is the prevention of ricochets. To this end, outdoor ranges often use a large dirt berm behind the target to decelerate and trap the bullet. There is also a growing desire to build shooting ranges within enclosed structures. This permits frequent use of the range regardless of weather and without excessive travel time. Obviously, use of a dirt berm behind the target is impractical for indoor ranges.

For both indoor and outdoor use, current trends in bullet containment systems focus on two different types of systems. The first, often called a bullet stop and containment chamber, has a pair of plates that channel bullets toward an opening in a containment chamber. Inside the containment chamber are impact plates that slow the bullet to a stop. Unfortunately, such systems are relatively expensive and difficult to manufacture and maintain.

The second, more common type of containment system is the bullet backstop or bullet trap system. Bullet backstops typically include a back plate made of steel inclined to the line of fire. The upper surface of the back plate is covered with a layer of loose particulate material as a medium for decelerating and trapping incoming bullets. This layer is several feet thick in the direction the bullet travels. The impact material is typically a resilient granular material. As bullets impact the material, they will decelerate sufficiently such that, if they do impact the back plate, any ricochet will be minimal. A number of bullet traps utilize rubber chunks or chips as the impact material. For example, U.S. Pat. No. 6,378,870 to Sovine ("the '870 Patent") teaches the use of relatively large rubber nuggets disposed along a plane inclined to the line of fire, while U.S. Pat. No. 5,848,794 to Wojcinski et al. ("the '794 Patent") discloses a similar bullet trap using relatively small rubber granules disposed along an inclined plane.

However, incoming rounds tend to dislodge the loose particulate matter, splashing and scattering it about the trap, and throwing some loose particulate out of the trap altogether. Furthermore, the vibrations induced by incoming rounds will cause the particulate to stuff. The combination of splashing, scattering, and sluffing reduces the thickness of the particulate layer in the direction the bullet travels, particularly in the area directly behind the target. This in turn increases the likelihood of ricochets off the back plate. Higher impact velocities compound these problems.

While traps of reduced slope may diminish sluffing, they do so at the expense of increasing the size of the trap along the line of fire. Furthermore, reduced-slope traps remain susceptible to splash and scatter. Thus, to ensure a safe thickness of particulate, it remains necessary to periodically rake dislodged particulate back into place or otherwise replenish the trap.

To address splashing and scatter of loose particulate, extant systems, such as that disclosed in U.S. Pat. No. 5,901,960 to Nesler et al. ("the '960 Patent"), often utilize a membrane of elastomer, fabric, or netting to cover the particulate. Since the membrane is thin and light, it must somehow be anchored in place, typically by attachment to the back plate or other support structure. While the membrane reduces the occurrence of splash and scatter, the particulate beneath the membrane remains susceptible to sluffing. Since the membrane does not serve to decelerate incoming rounds, rounds may impact the back plate with sufficient velocity to ricochet if the particulate beneath the membrane is not carefully monitored to ensure it remains at a thickness sufficient to completely decelerate and trap incoming rounds.

After a number of firing sessions, the portion of the membrane in the target zone will be destroyed and no longer capable of restraining the loose particulate. Though the remainder of the membrane may still be viable, it is necessary to replace the entire membrane. Alternatively, the destroyed portion could be repaired with a patch. If patching is preferred, the trap must be taken out of service until the patch cures, and some solvents used in patching have been known to cause fires.

SUMMARY OF THE INVENTION

Accordingly, it is an object of the present invention to provide a projectile trap cover that addresses splashing, scatter, and sluffing of loose particulate projectile trapping media.

Another object of the present invention is to provide a modular projectile trap cover that eliminates the need to anchor the cover to the backstop.

Yet another object of the present invention is to provide a cover for a loose-particulate projectile backstop that reduces ricochet hazards introduced by sluffing of the loose particulate projectile trapping media.

Still another object of the present invention is to provide a cover for a projectile backstop that permits replacement of only the destroyed portion of the cover.

A further object of the present invention is to provide a flexible and modular projectile trapping element.

The invention is a modular bullet trap cover element that generally includes a shell filled with a projectile trapping medium, preferably a mixture of a resilient granular ballistic medium and a hydrated super absorbent polymer (SAP) gel. The projectile trapping medium may also include at least one additive, preferably formed as at least one low density, self-dispensing block. The shell may be made of any of a number of fabric or polymeric materials.

In the preferred embodiments of the invention, the shell includes two bags, an inner bag and an outer bag, each of which has an open end and a sealed end. However, in embodiments, a second outer bag is provided to create a three-layer shell. The inner and outer bags are connected to one another such that the outer bags may be inverted over the inner bag to cover at least a portion thereof. That is, the sealed end of the outer bags is attached to at least the open end, and in embodiments the sealed end, of the inner bag. The modular cover element is formed by filling the inner bag with the projectile trapping medium and then inverting the outer bags to produce a double- or triple-layer shell. In embodiments, the outer bags and inner bag are rotatably connected, for example by one or more tabs or straps, thereby permitting the outer bags to be rotated with respect to the inner bag such that bullet holes in the inner and outer bag no longer line up with each other.

Several modular cover elements may be interconnected, preferably in a mattress-like arrangement, to form a bullet trap cover. Interconnection may be temporary (e.g., releasable) or permanent (e.g. fixed), and may be via any of a number of fasteners, including, but not limited to, hook-and-loop fasteners, ties, snaps, and any combination thereof. This cover may then be placed on the upper surface of a loose-particulate or other bullet trap to cover at least a portion thereof; the elements may be interconnected before, or preferably after, they are placed.

Further advantages of the present invention will be apparent from the description below with reference to the accompanying drawings, in which like numbers indicate like elements.

DETAILED DESCRIPTION OF PREFERRED EMBODIMENTS OF THE INVENTION

Figure 1:
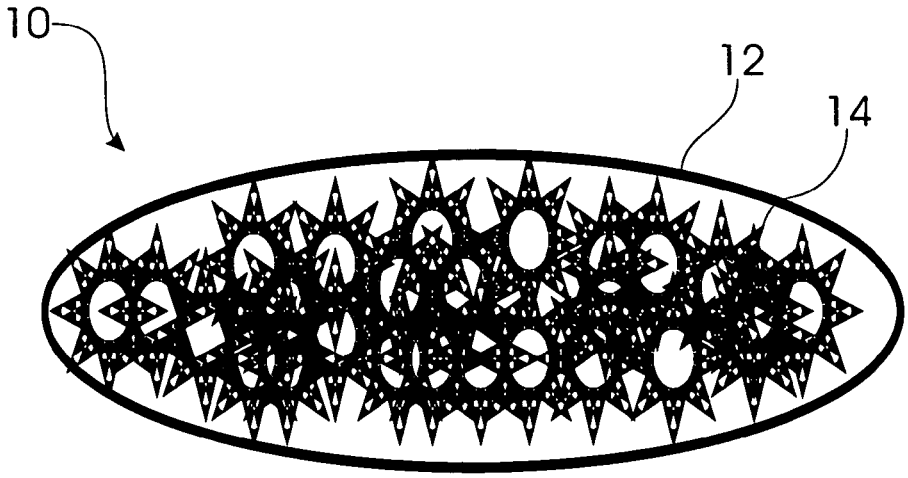
FIG. 1 is a cross-sectional view of a modular cover element according to the present invention.

Referring now to the drawings, and specifically to FIG. 1, there is shown a modular projectile cover element 10. (It should be understood that the terms "bullet," "projectile," and "round" are used interchangeably herein and refer to projectiles or munitions of any sort or caliber.) Modular cover element 10 generally includes a shell 12 filled with a projectile trapping medium 14. As discussed below, shell 12 is preferably two-ply, but may also be single- or triple-ply.

Figure 2:
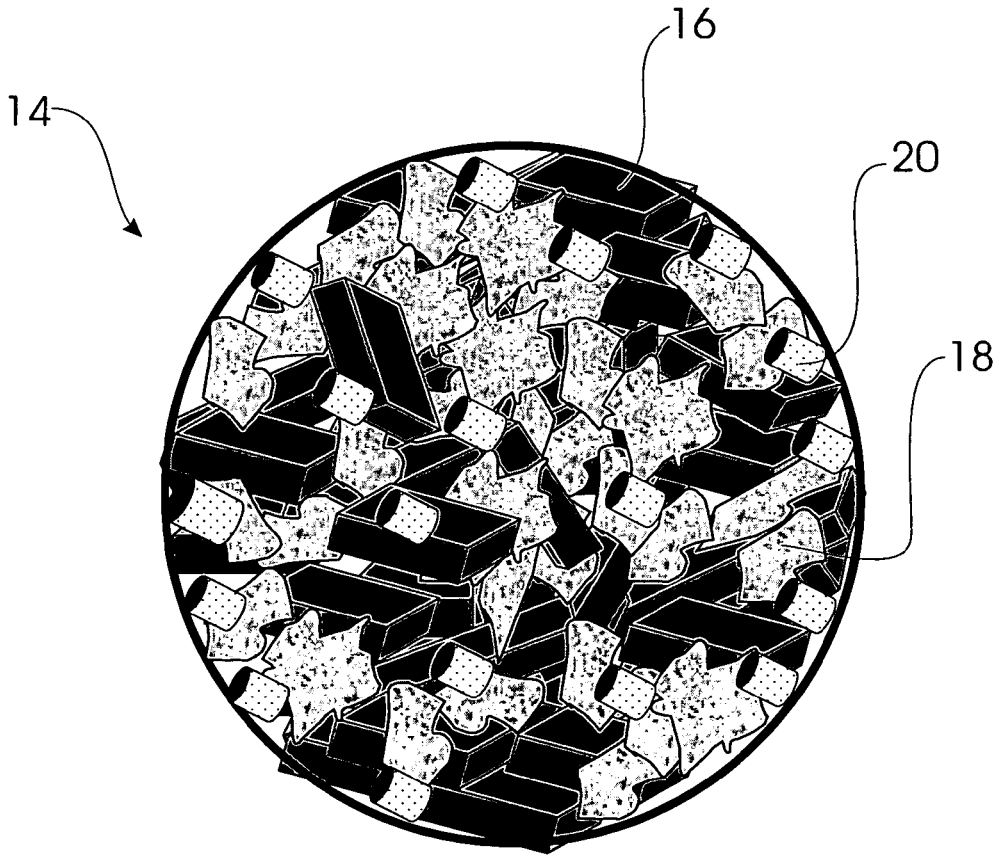
FIG. 2 is a close-up view of the projectile trapping medium used as fill material for a modular cover element according to the present invention.

As best shown in FIG. 2, projectile trapping medium 14 includes a resilient granular ballistic medium 16, such as rubber chunks, wood chips, plastic scrap, or any other material that will not produce a ricochet when impacted by a bullet, mixed with a hydrated super absorbent polymer (SAP) gel 18. Rubber chunks are preferred for ballistic medium 16 because of their durability when subjected to impacts from incoming bullets. The mixture forms an "artificial soil" of ballistic medium 16 "chunks" in an SAP gel 18 matrix. That is, ballistic medium 16 serves as a framework to hold hydrated SAP gel 18, and hydrated SAP gel 18 occupies interstices within ballistic medium 16.

SAP will absorb up to 400 times its mass in water, such that the resulting hydrated SAP gel 18 can be up to 97.5% water by mass, with nearly the density of water. Thus, for modular cover elements 10 employed outside, rainfall enhances, rather than impairs, performance. SAP material is marketed in a variety of forms (e.g., granules, powders, and fibers). Preferably, hydrated SAP gel 18 is a sodium or potassium acrylate, acrylamide, or carboxylate polymer, or some combination thereof. Further, the mixture of ballistic medium 16 and SAP gel 18 may be more than 50% SAP by volume, such that there is a substantially reduced likelihood of fire when struck by incoming rounds, thereby reducing or eliminating the need for flame retardant additives.

The preferred cross-linked polyacrylate and polyamide SAP gels 18 are most stable when maintained in a wet condition with a pH above 4.5, as they tend to shrink and shed water in acids. Additionally, higher alkalinities reduce the solubility of lead and other heavy metal ions. Preferably, the pH is maintained between about 8 and 12, and most preferably at about 10.4.

Further, SAP gel has an inherent ability to bind lead. For example, Cetco, Inc. of Arlington Heights, Ill. claims that a granular cross-linked polyacrylate will absorb a 30 ppm lead solution, producing a volume change of 110 times the volume of the absorbent. However, most of the lead passing through modular cover element 10 will be in the form of metallic lead.

Thus, in embodiments, at least one additive is mixed into projectile trapping medium 14. Preferably, pH-adjusting (buffering) additives and lead passivating additives are used, though other additives (e.g., flame-retardant additives) may be desirable in a particular application and are contemplated. Preferably, the additives are formed as low density, self-dispensing blocks 20 having a low solubility in water, such that, when impacted by incoming fire, the resultant flakes of additive will remain as powdery solids in the mixture.

Appropriate choices for additives are phosphates, carbonates, hydroxides, silicates, and bicarbonates, either singly or in combination, since these additives can serve both purposes noted above. That is, they will both increase the pH of SAP gel 18 and passivate heavy metals. They can also help chemically stabilize hydrated SAP gel 18, retard the growth of mold or bacteria in hydrated SAP gel 18, and enhance the flame retardant characteristics of projectile trapping medium 14. One skilled in the art will understand how to select an appropriate cation, such as potassium, sodium, aluminum, magnesium, or calcium, for the additive. It will also be apparent to one skilled in the art that different or additional additives may be used as well. However, as will be discussed below, the most preferred additives are calcium phosphate, calcium carbonate, and aluminum hydroxide.

The use of buffering and passivating additives with SAP presents additional considerations. SAP absorbs less water per unit dry weight when the water around it contains large quantities of dissolved materials. For example, a typical SAP will absorb approximately 50 times its dry weight in water in a 1% NaCl solution, but only 22 times its dry weight in a 10% NaCl solution. Most buffering and passivating compounds are most effective when they are in solution in reasonably constant concentrations. Additionally, soluble forms of phosphorus can leach out of the SAP mixture, causing environmental pollution. Furthermore, any phosphate precipitated as lead or copper phosphate is no longer available to act as a buffer.

The present invention preferably addresses these considerations by using calcium phosphate compounds having low solubilities as additives. The concentration of these calcium compounds in solution is never high enough to alter the water absorbance of the SAP. However, as the phosphate is removed by reactions with lead and copper, more solid (particulate) calcium phosphate dissolves to maintain a saturated, but not very concentrated, solution. In addition to calcium phosphate compounds, calcium carbonate and aluminum hydroxide are valuable additives. Calcium carbonate provides additional buffering capacity, while aluminum hydroxide adds to the buffering capacity and can also react with lead phosphates to form very insoluble lead aluminum phosphates.

It will be apparent to one skilled in the art how to produce an SAP mixture with a pH in the desired range and saturated with respect to the additives used. One useful method of designing projectile medium 14 is to estimate the volume of ballistic medium 16 to be employed in modular cover element 10 and determine the proportion of interstices in that volume. Typically, this would be approximately 50% of the volume of ballistic medium 16. Assume that the density of hydrated SAP gel 18 needed to fill the interstices will approximate that of water and calculate the required weight of hydrated SAP gel 18. Each additive can then be added to bullet trapping medium 14 as 5 to 10 parts of each additive for every 100 parts of hydrated SAP gel 18.

Figure 3:
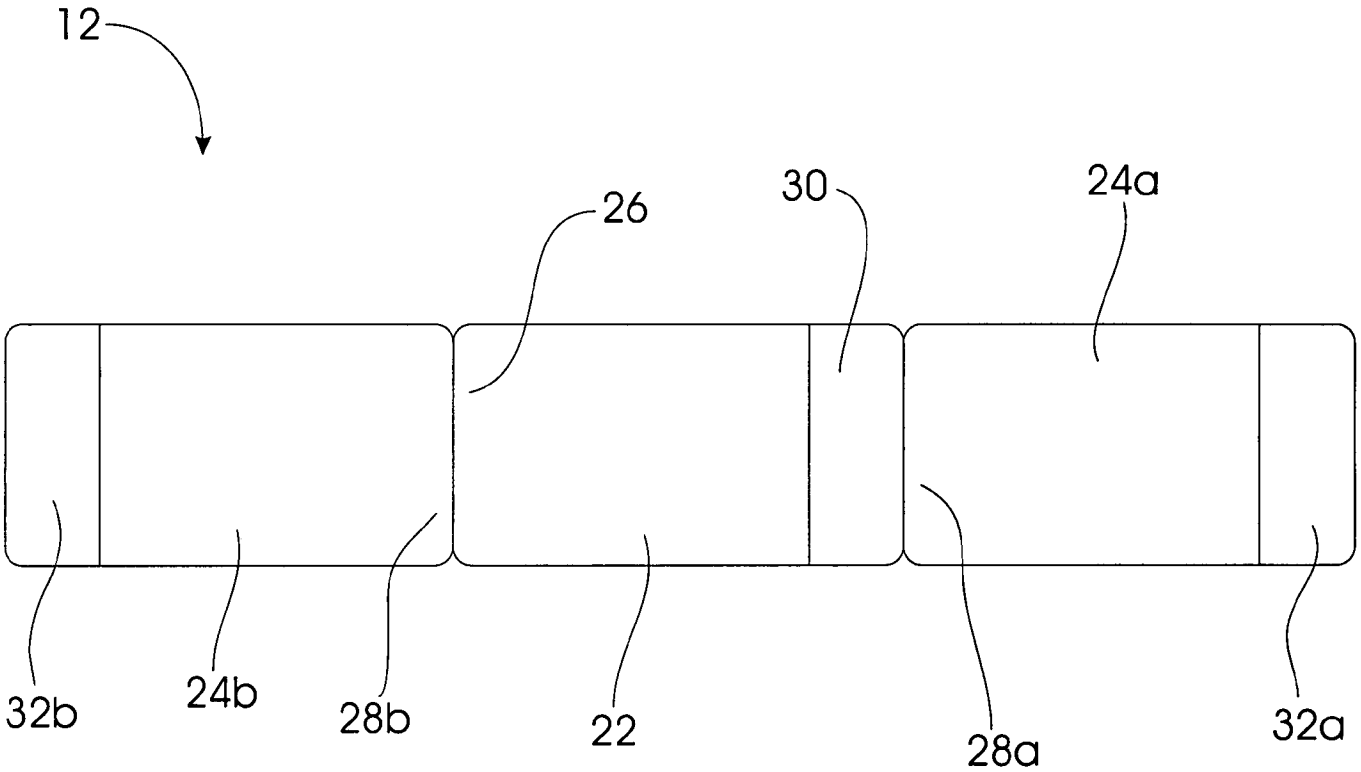
FIG. 3 illustrates an open triple-layer shell for a modular cover element according to the present invention.

As shown in FIG. 3, shell 12 preferably includes an inner bag 22 and at least one outer bag 24, shown in FIG. 3 as two outer bags 24*a* and 24*b*. Bags 22, 24 have sealed ends 26, 28 and open ends 30, 32, respectively. Sealed end 28*a* of outer bag 24*a* is attached to open end 30 of inner bag 22, permitting outer bag 24*a* to be inverted over inner bag 22 to provide the preferred double-layer shell 12. In embodiments, sealed end 28*b* of outer bag 24*b* is attached to sealed end 26 of inner bag 22, permitting outer bag 24*b* to be inverted over inner bag 22 to provide a triple-layer shell, though, as noted above, the preferred embodiments of the invention employ a double-layer shell 12 rather than a triple-layer shell 12.

Figure 4:
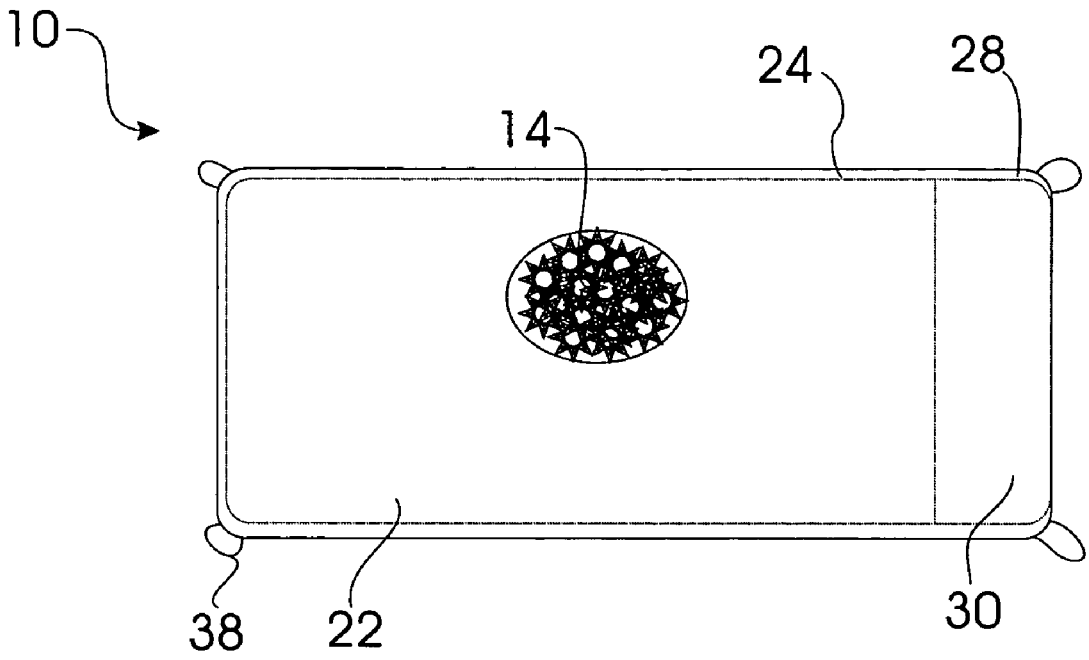
FIG. 4 illustrates a closed shell for a modular cover element according to the present invention.

Modular cover element 10 is formed by filling inner bag 22 (shown in hidden lines) with projectile trapping medium 14, and inverting outer bags 24 to cover at least a portion of inner bag 22 as shown in FIG. 4. (For the sake of illustration only, overlapping portions of bags 22, 24 are shown as transparent in FIG. 4.) One skilled in the art will recognize that the order of inversion of outer bags 24*a*, 24*b* over inner bag 22 in the triple-layer embodiment of shell 12 is irrelevant, as long as sealed end 28 of an outer bag 24 covers open end 30 of inner bag 22 to prevent spillage of projectile trapping medium 14 therein (that is, outer bag 24*a* must be provided, but outer bag 24*b* is optional).

Figure 5:
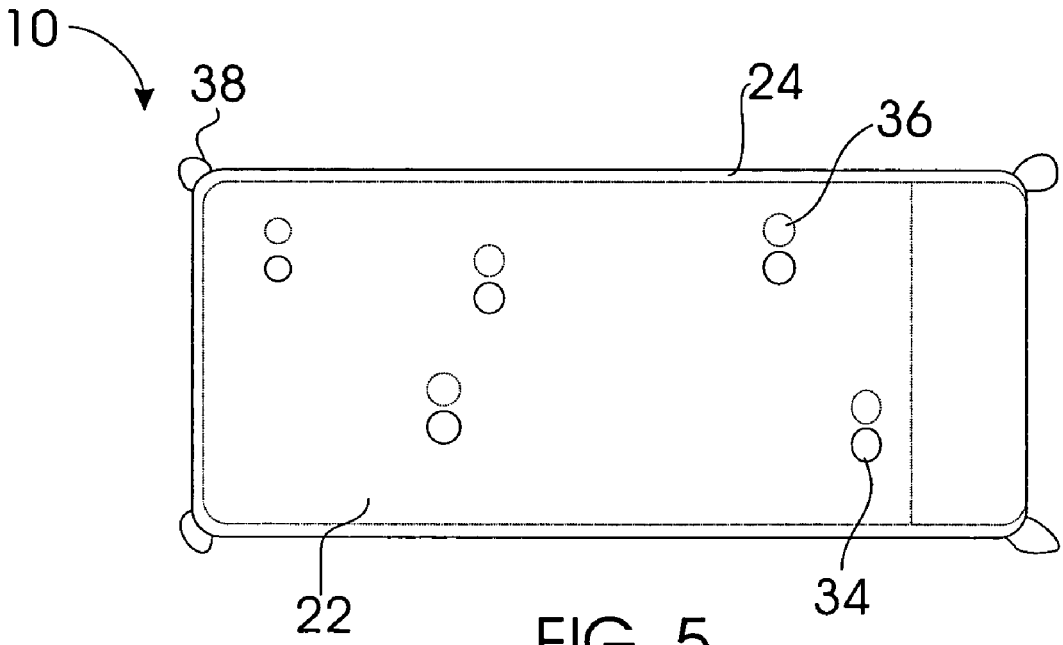
FIG. 5 illustrates how a rotatable multiple-layer shell can be used to prolong the life of a modular cover element according to the present invention.

Preferably, bags 22 and 24 are rotatably attached to each other. As shown in FIG. 5, a rotatable attachment permits outer bag 24 to be rotated with respect to inner bag 22 such that bullet holes 34 in outer bag 24 no longer line up with bullet holes 36 in inner bag 22, thereby prolonging the useful life of shell 12, and therefore of modular cover element 10, without patching.

Figure 6A:
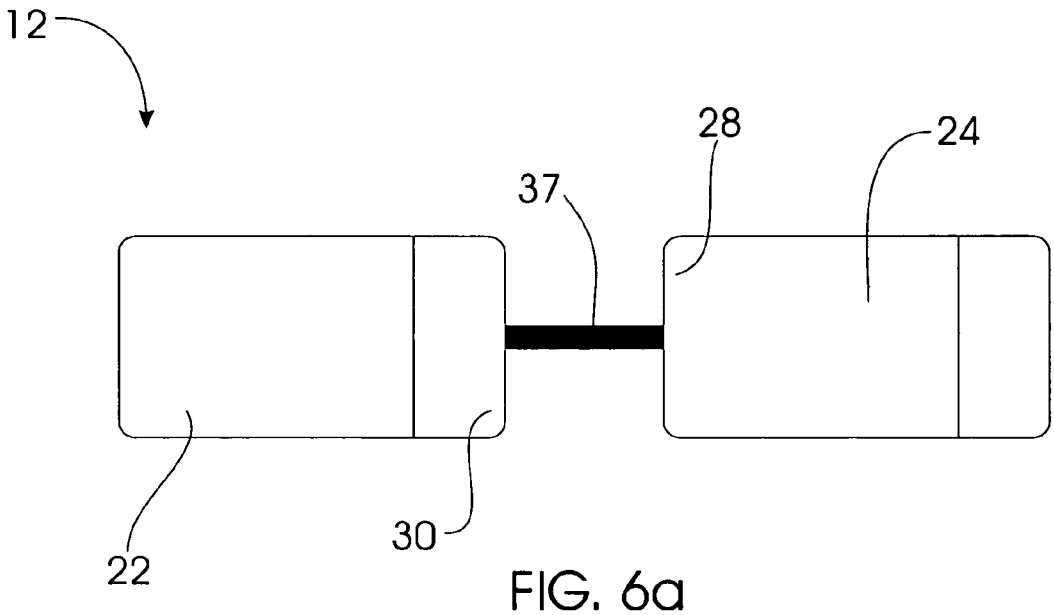
FIG. 6*a* illustrates one embodiment of a rotatable double-bag shell according to the present invention.
Figure 6B:
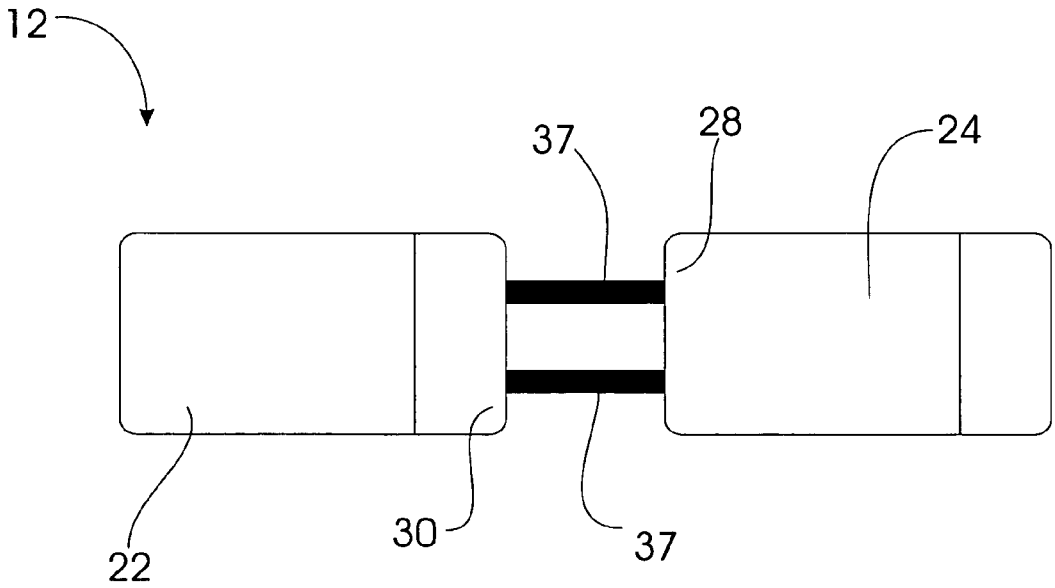
FIG. 6*b* illustrates a second embodiment of a rotatable double-bag shell according to the present invention.

As shown in FIGS. 6*a* and 6*b*, inner and outer bags 22, 24 are preferably rotatably attached via one or more attachment tabs or straps 37 attached to at least one of open end 30 of inner bag 22 and sealed end 28 of outer bag 24. Tabs or straps 37 twist as outer bag 24 is rotated with respect to inner bag 22, and therefore are preferably made of a material sufficiently ductile to so twist without failing in torsion, such as fabric or cord, or polymeric or elastomeric sheet. In the embodiment shown in FIG. 6*a*, only one tab or strap 37 is provided substantially at the center of open end 30 and sealed end 28. The embodiment shown in FIG. 6*b* includes two tabs or straps 37 positioned substantially symmetrically about the center of open end 30 and sealed end 28. One skilled in the art will recognize how to attach bags 22, 24 using more than two tabs or straps 37, and will further recognize that the length of tabs or straps 37 must be adjusted to allow for twisting without distorting bags 22, 24.

Figure 6C:
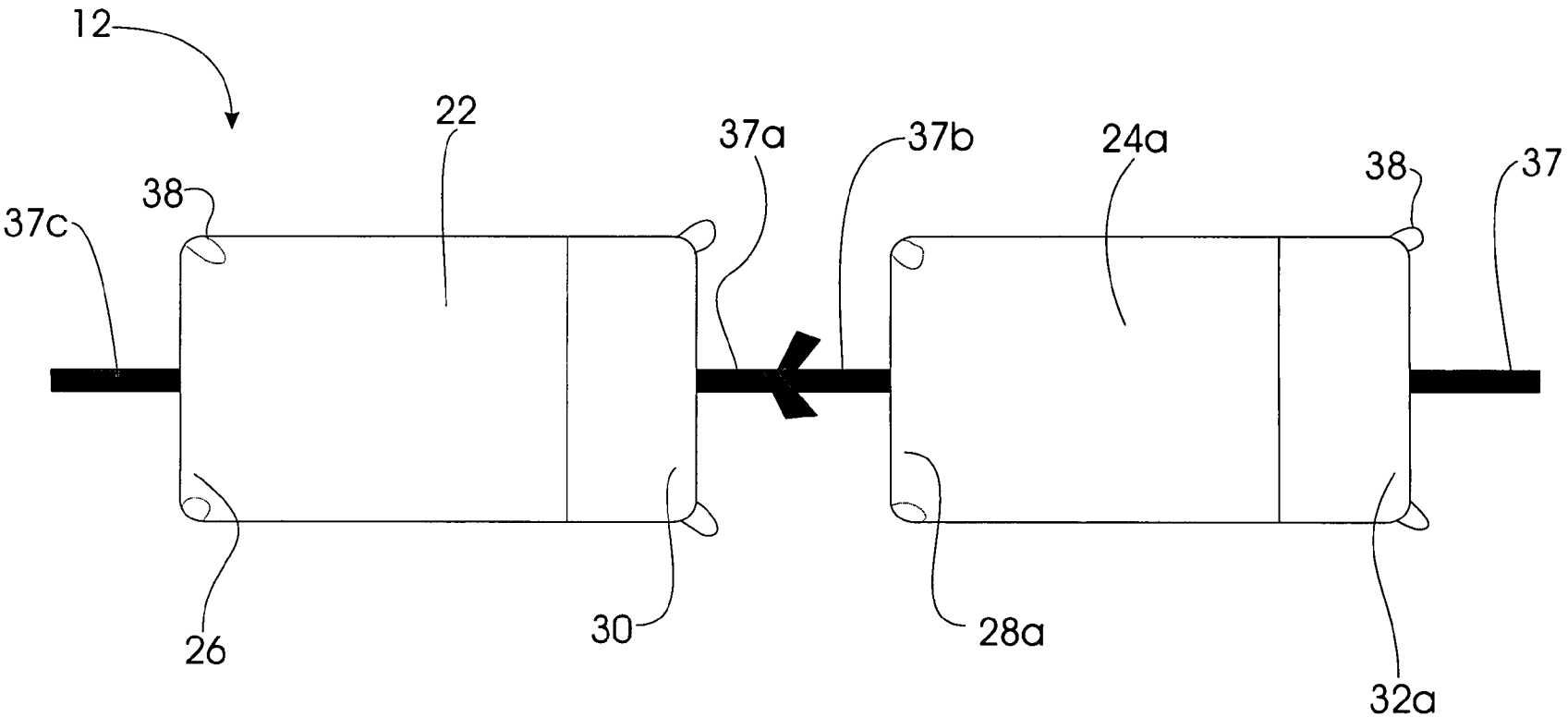
FIG. 6*c* illustrates the most preferred embodiment of the rotatable double-bag shell according to the present invention.

FIG. 6*c* illustrates the most preferred embodiment of a double-layer shell 12 according to the present invention. Inner bag 22 and outer bag 24*a* have attachment straps or tabs 37 on both their sealed ends 26, 28*a* and open ends 30, 32*a*, respectively. Attachment tab or strap 37*a*, which is attached to open end 30 of inner bag 22, is knotted to attachment tab or strap 37*b*, which is attached to sealed end 28*a* of outer bag 24*a*. One skilled in the art will recognize that, in this preferred embodiment of the invention, inner bag 22 and outer bag 24*a* are interchangeable, permitting the invention to be practiced by simply manufacturing several identical bags and knotting them together via attachment tabs or straps 37 as desired to form a double-layer shell 12. One skilled in the art will further recognize that the triple-layer shell 12 described above could be formed by attaching the sealed end 28*b* of an additional identical outer bag 24*b* to the attachment tab or strap 37*c* positioned at sealed end 26 of inner bag 22.

Shell 12 may be constructed from any of a number of fabric or polymeric materials, including, but not limited to, nylon netting, nylon mesh, and polypropylene, but is preferably constructed from rip-stop nylon. In embodiments, shell 12 is self-healing. Further, shell 12 is preferably water-permeable to permit hydration of SAP gel 18 and to facilitate migration of buffering and passivating additives out of modular cover element 10 into the underlying bullet backstop.

At least one fastener 38 is optionally provided on shell 12 to permit interconnection between several modular cover elements 10. The preferred fasteners 38 are hook-and-loop fasteners, ties, and snaps because of the ease and rapidity with which they can be employed, though other fasteners may be employed without departing from the scope of the invention. In the preferred embodiment of the invention, where two bags are tied together via attachment tabs or straps 37, fasteners 38 positioned on the sealed end of the bag are provided on the inside seam, such that when outer bag 24 is inverted over inner bag 22 these fasteners 38 will be on the outside of shell 12. Preferably, four fasteners 38 are accessible when the outermost outer bag 24 is inverted over inner bag 22.

Figure 7:
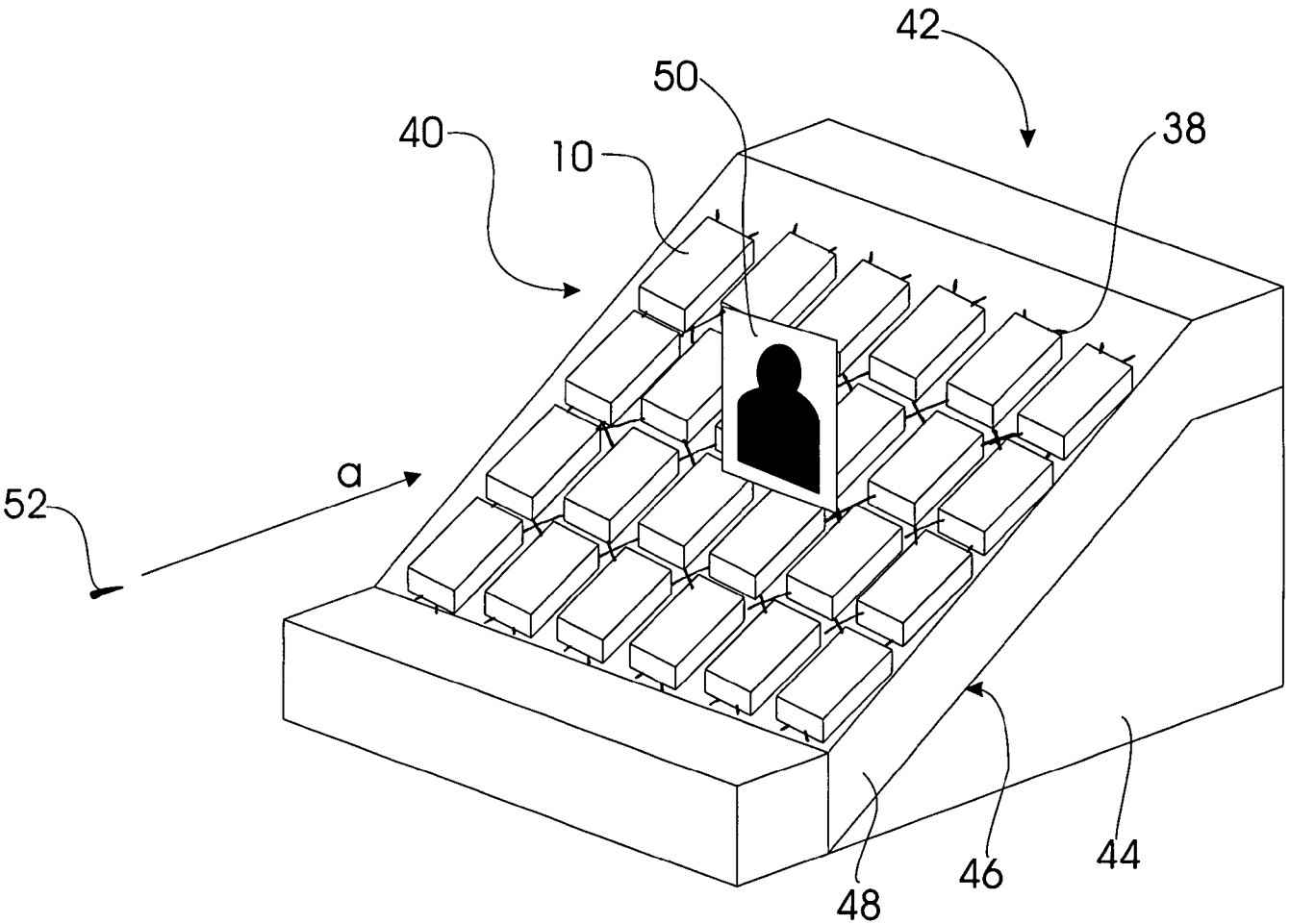
FIG. 7 is a perspective view of a projectile trap covered with the modular cover elements according to the present invention.

Turning now to FIG. 7, a cover 40 for a projectile backstop 42 is shown. Backstop 42 generally includes a foundation or support structure 44 having an upper surface 46, at least a portion of which is inclined with respect to line of fire "a." One skilled in the art will understand that support structure 44 may take any number of forms (e.g., a dirt or earth berm, a concrete pad, a steel frame, a wood frame) without departing from the scope of the present invention. A ballistic medium 48, preferably projectile trapping medium 14, is disposed (e.g., piled) on upper surface 46.

At least one modular cover element 10 is disposed atop ballistic medium 48, covering a portion thereof. In the preferred embodiment of the invention, cover 40 includes a plurality of modular cover elements 10 arranged in a mattress-type configuration and covering at least the portion of ballistic medium 48 behind a target 50. The several modular cover elements 10 may be fixedly or releasably interconnected via fasteners 38. If releasably interconnected, the several modular cover elements 10 are preferably interconnected after being placed atop ballistic medium 48 for the sake of convenience. The weight of modular cover elements 10 keeps cover 40 in place atop ballistic medium 48 without the need to secure it to support structure 44. Further, shells 12 may be specially colored or marked to designate different regions (e.g., target regions, no-fire regions) of backstop 42 covered by particular segments of cover 40.

An incoming round 52 passes through cover 40 (e.g., through a modular cover element 10), where it begins to decelerate passing through projectile trapping medium 14. It also fractures any self-dispensing additive blocks 20 that it contacts; the resultant powder or flakes can migrate into ballistic medium 48 with any moisture passing through cover 40, thereby continuously replenishing additives in ballistic medium 48.

After passing through cover 40, round 52 impacts ballistic medium 48. The weight of modular cover elements 10, coupled with the reduced velocity caused by projectile trapping medium 14, limits scatter, splashing, and sluffing of ballistic medium 48. In the event that ballistic medium 48 erodes from the impact area, the deceleration caused by projectile trapping medium 14 reduces the likelihood of any ricochet, and considerably reduces the likelihood of a dangerous ricochet, since round 52 must pass through cover 40 a second time before becoming a hazard to range personnel.

Periodically, outer bag 24 is rotated with respect to inner bag 22 as described above. When further rotation is no longer viable or desirable, the destroyed element can be quickly and easily removed, and a new element inserted, without disturbing the remainder of cover 40 or taking the range out of service for an extended period of time. Further, in the preferred embodiments of the invention, it is possible to replace only that portion of shell 12 that needs replacement by detaching outer bag 24 from inner bag 22.

While the invention has been described in terms of its preferred embodiments, those skilled in the art will recognize that the invention can be practiced with modifications within the spirit and scope of the appended claims. For example, though the invention has been described in the context of covering a projectile trap, the modular cover elements could be used as a projectile trap in their own right, for example to build barriers between lanes on a firing range. Thus, it is intended that all matter contained in the foregoing description or shown in the accompanying drawings shall be interpreted as illustrative rather than limiting, and the invention should be defined only in accordance with the following claims and their equivalents.

What is claimed is:

1. A projectile backstop cover element comprising a shell filled with a projectile trapping medium, said projectile trapping medium comprising a resilient granular ballistic medium mixed with a hydrated super absorbent polymer (SAP) gel, wherein said shell comprises:

an inner bag having a sealed end and an open end; and at least one outer bag having a sealed end and an open end, wherein said sealed end of one of said at least one outer bag is attached to said open end of said inner bag; and wherein said at least one outer bag is invertible over said inner bag to cover at least a portion thereof.

2. The projectile backstop cover element according to claim 1, wherein said inner bag and said at least one outer bag are rotatably attached to each other.

3. The projectile backstop cover element according to claim 2, wherein said inner bag and said at least one outer bag are rotatably attached via at least one strap, said at least one strap being secured to at least one of said sealed end of said at least one outer bag and said open end of said inner bag.

4. The projectile backstop cover element according to claim 3, wherein said at least one strap is at least one first strap secured to said sealed end of said outer bag and at least one second strap secured to said open end of said inner bag, and wherein said at least one first strap and said at least one second strap are tied together.

5. The projectile backstop cover element according to claim 3, wherein said at least one strap is substantially centrally located along said sealed end of said at least one outer bag and said open end of said inner bag.

6. The projectile backstop cover element according to claim 3, wherein said at least one strap is at least two straps.

7. The projectile backstop cover element according to claim 6, wherein said at least two straps are substantially symmetrically disposed along said sealed end of said at least one outer bag and said open end of said inner bag.

8. The projectile backstop cover element according to claim 1, wherein said shell further comprises at least one fastener.

9. The projectile backstop cover element according to claim 8, wherein said at least one fastener is selected from the group consisting of hook-and-loop fasteners, ties, snaps, and any combination thereof.

10. The projectile backstop cover element of claim 1, wherein said projectile trapping medium further comprises at least one additive.

11. The projectile backstop cover element of claim 10, wherein said at least one additive is formed as at least one low density, self-dispensing block.

12. The projectile backstop cover element of claim 1, wherein said shell comprises a fabric shell.

13. The projectile backstop cover element of claim 1, wherein said shell comprises a polymeric shell.

14. The projectile backstop cover element of claim 13, wherein said polymeric shell comprises a self-healing elastomeric shell.

15. The projectile backstop cover element of claim 1, wherein said shell comprises a water-permeable shell.

16. A cover for a projectile backstop, said cover comprising a plurality of shells filled with a projectile trapping medium, said projectile trapping medium comprising a resilient granular ballistic medium mixed with a hydrated super absorbent polymer (SAP) gel, wherein each said shell comprises:

an inner bag having a sealed end and an open end; and at least one outer bag having a sealed end and an open end, wherein said sealed end of one of said at least one outer bag is attached to said open end of said inner bag; and wherein said at least one outer bag is invertible over said inner bag to cover at least a portion thereof.

17. The cover according to claim 16, wherein said plurality of shells are interconnected.

18. The cover according to claim 17, wherein said plurality of shells are releasably interconnected.

19. A backstop for decelerating and trapping projectiles, said backstop comprising:

a piled ballistic medium; and at least one cover element disposed atop said piled ballistic medium and covering at least a portion thereof, said at least one cover element comprising a shell filled with a projectile trapping medium, the projectile trapping medium comprising a resilient granular ballistic medium mixed with a hydrated super absorbent polymer (SAP) gel.

20. The backstop of claim 19, wherein said shell comprises an inner bag incorporating a sealed end opposite an open end and at least one outer bag incorporating a sealed end opposite an open end, at least said inner bag and one said outer bag rotatably attached one to the other.

21. The backstop of claim 20, wherein said inner bag and said outer bag are rotatably attached via at least one strap, said at least one strap being secured to at least said sealed end of said outer bag and said open end of said inner bag.

22. The backstop of claim 21 in which said at least one strap is at least one first strap secured to said sealed end of said outer bag and at least one second strap secured to said open end of said inner bag, wherein said at least one first strap and said at least one second strap are tied together.

23. The backstop of claim 21 in which said at least one strap is substantially centrally located along said sealed end of said outer bag and said open end of said inner bag.

24. The backstop of claim 21 in which said at least one strap is at least two straps.

25. The backstop of claim 24 in which said at least two straps are substantially symmetrically disposed along said sealed end of said outer bag and said open end of said inner bag.

26. The backstop of claim 21 in which said at least one outer bag is two outer bags, a first outer bag and a second outer bag, said sealed end of said first outer bag being attached to said open end of said inner bag, and said sealed end of said second outer bag being attached to said sealed end of said inner bag.

27. A method of constructing a projectile trapping cover element comprising the steps of:

providing at least one shell;

wherein said step of providing at least one shell comprises providing at least one shell comprising an inner bag having a sealed end and an open end and at least one outer bag having a sealed end and an open end, wherein the sealed end of one of the at least one outer bag is attached to the open end of the inner bag;

providing a projectile trapping medium comprising a resilient granular ballistic medium mixed with a hydrated super absorbent polymer (SAP) gel; and filling the at least one shell with the projectile trapping medium, wherein said step of filling the at least one shell with the projectile trapping medium comprises filling the inner bag with the projectile trapping medium; and further comprising the step of inverting the at least one outer bag over the inner bag to cover at least a portion thereof.

28. The method according to claim 27, wherein the projectile trapping medium further comprises at least one additive.

29. A method of covering a projectile backstop comprising the steps of:

filling a plurality of shells with a projectile trapping medium comprising a resilient granular ballistic medium mixed with a hydrated super absorbent polymer (SAP) gel wherein each said shell comprises:

an inner bag having a sealed end and an open end; and at least one outer bag having a sealed end and an open end, wherein said sealed end of one of said at least one outer bag is attached to said open end of said inner bag; and wherein said at least one outer bag is invertible over said inner bag to cover at least a portion thereof; and disposing the plurality of filled shells on an upper surface of the projectile backstop to cover at least a portion thereof.

30. The method according to claim 29, further comprising the step of interconnecting the plurality of filled shells.

* * * * *